US008505641B2

(12) United States Patent
Tsuji et al.

(10) Patent No.: US 8,505,641 B2
(45) **Date of Patent: *Aug. 13, 2013**

(54) ELECTRIFICATION SPRAY HEAD

(71) Applicant: Hochiki Corporation, Tokyo (JP)

(72) Inventors: Toshihide Tsuji, Tokyo (JP); Tatsuya Hayashi, Tokyo (JP); Tetsuo Yoshida, Tokyo (JP)

(73) Assignee: Hochiki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/728,251

(22) Filed: Dec. 27, 2012

(65) Prior Publication Data

US 2013/0119169 A1 May 16, 2013

Related U.S. Application Data

(63) Continuation of application No. 13/232,066, filed on Sep. 14, 2011, now Pat. No. 8,365,836, which is a continuation of application No. PCT/JP2009/058246, filed on Apr. 27, 2009.

(51) Int. Cl.
*A62C 37/08* (2006.01)

(52) U.S. Cl.
USPC ..... 169/37; 169/5; 169/54; 239/251; 239/380; 239/403; 239/404; 239/432; 239/491; 239/492; 239/690; 239/690.1; 239/696; 239/708

(58) Field of Classification Search
USPC ..... 169/5, 16, 45–47, 37, 54; 239/251, 239/380, 398, 403, 404, 432, 491, 492, 565, 239/690, 690.1, 695, 696, 708
See application file for complete search history.

(56) References Cited

U.S. PATENT DOCUMENTS

| | | | | |
|---|---|---|---|---|
| 4,703,891 | A * | 11/1987 | Jackson et al. | 239/695 |
| 5,353,879 | A | 10/1994 | Watanabe et al. | |
| 6,189,622 | B1 | 2/2001 | Audet et al. | |
| 7,017,673 | B2 | 3/2006 | Gargani | |
| 7,578,454 | B2 | 8/2009 | Joo | |
| 8,365,836 | B2 * | 2/2013 | Tsuji et al. | 169/16 |
| 2011/0186311 | A1 | 8/2011 | Tsuji et al. | |

FOREIGN PATENT DOCUMENTS

| | | |
|---|---|---|
| JP | 58-174258 | 10/1983 |
| JP | 03-186277 | 8/1991 |
| JP | 08-266676 | 10/1996 |
| JP | 09-299503 | 11/1997 |

(Continued)

*Primary Examiner* — Steven J Ganey
(74) *Attorney, Agent, or Firm* — Wenderoth, Lind & Ponack, L.L.P.

(57) ABSTRACT

A wide protection range can be ensured by extending the flying distance of fire-extinguishing agent particles electrified and sprayed from a head. A water-based fire-extinguishing agent is pressurized and supplied to an electrification spray head 10 installed in a protection area A via a pipe, the jetted particles of the fire-extinguishing agent are electrified and sprayed from the electrification spray head 10. The electrification spray head mixes and sprays the fire-extinguishing agent having a comparatively small particle size included in a range from 30 μm to 200 μm by a small-particle jetting nozzle 38*a* and the fire-extinguishing agent having a comparatively-large particle size of 200 μm to 2000 μm by a large-particle jetting nozzle 38*b*, thereby carrying the group of the fire-extinguishing-agent particles having the small particle size by the air current caused by spraying the group of the fire-extinguishing-agent particles having the large particle size.

4 Claims, 10 Drawing Sheets

(56) References Cited

FOREIGN PATENT DOCUMENTS

| | | |
|---|---|---|
| JP | 10-118214 | 5/1998 |
| JP | 11-192320 | 7/1999 |
| JP | 2002-017883 | 1/2002 |
| JP | 2007-279865 | 10/2007 |
| JP | 2008-523863 | 7/2008 |
| WO | 2006/064082 | 6/2006 |

* cited by examiner

ELECTRIFICATION SPRAY HEAD

This application is a Continuation Application of U.S. patent application Ser. No. 13/232,066, filed Sep. 14, 2011, which is a Continuation Application of International Application No. PCT/JP2009/058246, filed Apr. 27, 2009.

TECHNICAL FIELD

The present invention relates to fire prevention equipment for electrifying and spraying water-based fire-extinguishing agent particles containing water, seawater, and/or a fire-extinguishing chemical agent from a head.

BACKGROUND ART

Conventionally, the water-based fire prevention equipment of this type includes sprinkler fire extinguishment, water atomization fire-extinguishing equipment, water mist fire-extinguishing equipment, and so on. Particularly, the water mist fire-extinguishing equipment downsizes water particles to 20 to 200 μm or fraction of that of the sprinkler equipment or water atomization equipment and discharges the water particles to space, thereby expecting a fire extinguishing effect with a small water volume by a cooling effect and the oxygen supply inhibiting effect of evaporated water.

Recently, the sprinkler fire-extinguishing equipment, water atomization fire-extinguishing equipment, or water mist fire-extinguishing equipment using water as a fire extinguishing agent is re-evaluated since the equipment uses water friendly to the environment and human bodies as the fire extinguishing agent compared with gas-based fire-extinguishing agents of, for example, carbon dioxide and halon.

Patent Document 1: Japanese Patent Application Laid-Open Publication No. H11-192320

Patent Document 2: Japanese Patent Application Laid-Open Publication No. H10-118214

DISCLOSURE OF INVENTION

Problems to be Solved by the Invention

However, although the high fire extinguishing ability of the conventional sprinkler fire extinguishing equipment and water atomization fire-extinguishing equipment is generally known, the discharged water volume thereof is large in order to ensure the fire extinguishing ability, and reducing the wet damage caused upon fire extinguishment or after fire extinguishment is a problem.

On the other hand, the water mist fire-extinguishing equipment, which is assumed to cause small wet damage, is intended to obtain a cooling effect and the effect of inhibiting oxygen supply by evaporated water by filling space with comparatively small water particles; however, the fire extinguishing ability thereof is not so high in reality.

In order to solve such a problem, the inventors of the present application have proposed a fire prevention equipment (Japanese Patent Application No. 2007-279865) capable of enhancing the wetting effect with respect to burning objects by the Coulomb force acting on fire-extinguishing-agent particles to obtain a high fire extinguishing effect by electrifying the fire-extinguishing-agent particles sprayed from a head in case of fire and further capable of enhancing the effect of collecting the smoke generated by the fire by the Coulomb force of the fire-extinguishing-agent particles to enhance the smoke removing effect. In the case in which the used amount of the fire extinguishing agent is constant, the smaller the particle size of the fire extinguishing agent within the degree that the particles are not immediately evaporated and disappeared in the fire room atmosphere, the higher the above described fire extinguishing effect and smoke removing effect.

This is probably because: the smaller the particle size, the higher the amount of the particles which move around behind flammable objects and adhere thereto by the Coulomb force; and, the smaller the particle size, the higher the particle density (the number of particles in unit space), wherein the distance between the smoke particles and the particles of the fire extinguishing agent becomes small, and the collecting effect by the Coulomb force is increased.

On the other hand, the smaller the particles of the fire extinguishing agent, the more difficult it is to spray the particles of the fire extinguishing agent to all over the protection zone. For example, in the case of a spray head which generates water particles having a particle size of 200 μm at a water pressure of 1 MPa, the water particles are discharged from the head at an initial velocity of about 23 m/s; however, for example in the direction immediately lateral thereto, the particles stall at a flying distance of about 1 m or less due to air resistance.

Therefore, in order to spray the fire extinguishing agent of small particle sizes all over the protection zone, for example, a very large number of heads have to be disposed on the ceiling surface at small head intervals. This causes problems, for example, in terms of cost caused by the large number of heads or in terms of layout balance with lighting, etc., and in terms of layout balance with beams, etc. for extending pipes because of many pipes for supplying the fire extinguishing agent to the heads.

Means for Solving the Problems

According to the present invention, a fire prevention equipment capable of ensuring a wide protection range by extending the flying distances of the particles of a fire extinguishing agent electrified and sprayed from a head is provided.

The present invention is a fire prevention equipment having:

a fire-extinguishing agent supplying equipment pressurizing and supplying a water-based fire-extinguishing agent via a pipe;

an electrification spray head electrifying and spraying discharged particles of the water-based fire-extinguishing agent pressurized and supplied by the fire-extinguishing agent supplying equipment, the head being installed in a protection zone; and a voltage application unit applying an electrification voltage to the electrification spray head for electrification and spraying; wherein the electrification spray head has a head structure discharging the water-based fire-extinguishing agent including a mixture of a comparatively-small particle size and a comparatively-large particle size included in a predetermined particle size range.

Herein, the electrification spray head discharges the water-based fire-extinguishing agent including the mixture of the comparatively-small particle size and the comparatively-large particle size included in the range of 30 μm to 2000 μm.

Moreover, the electrification spray head has a small-particle-size head unit discharging the water-based fire-extinguishing agent having an average particle size within the range of 30 μm to 200 μm, and a large-particle-size head unit discharging the water-based fire-extinguishing agent having an average particle size within the range of 200μ to 2000 μm.

In the electrification spray head, the small-particle head unit and the large-particle head unit are laterally arranged to be adjacent to each other;

the small-particle-size head unit has:

a small-particle jetting nozzle converting the water-based fire-extinguishing agent into particles having the small particle size by jetting the agent to external space so as to spray the particles, a water-current swirling core swirling a water current supplied to the jetting nozzle, an induction electrode unit disposed in a jetting space side of the jetting nozzle, and a water-side electrode unit disposed in the jetting nozzle so as to be in contact with the water-based fire-extinguishing agent;

the large-particle-size head unit has:

a large-particle jetting nozzle converting the water-based fire-extinguishing agent into particles having the large particle size by jetting the agent to external space so as to spray the particles, a water-current swirling core swirling a water current supplied to the jetting nozzle, an induction electrode unit disposed in a jetting space side of the jetting nozzle, and a water-side electrode unit disposed in the jetting nozzle so as to be in contact with the water-based fire-extinguishing agent; and the voltage application unit applies external electric fields generated by applying a voltage between the induction electrode units and the water-side electrode units of the small-particle-size head unit and the large-particle-size head unit to the water-based fire-extinguishing agent being subjected to a jetting process by the small-particle jetting nozzle and the large-particle jetting nozzle so as to electrify the jetted particles.

The electrification spray head has:

a small-particle jetting nozzle converting the water-based fire-extinguishing agent into particles having the small particle size by jetting the agent to external space so as to spray the particles, a large-particle jetting nozzle coaxially disposed outside with respect to the small-particle jetting nozzle and converting the water-based fire-extinguishing agent into particles having a large particle size by jetting the agent to the external space so as to spray the particles, a water-current swirling core swirling a water current supplied to the small-particle-size jetting nozzle, a water-current swirling spiral swirling a water current supplied to the large-particle-size jetting nozzle, an induction electrode unit disposed in a jetting space side of the jetting nozzle, and a water-side electrode unit disposed in an inflow side of the jetting nozzles so as to be in contact with the water-based fire-extinguishing agent; and the voltage application unit applies an external electric field generated by applying a voltage between the induction electrode unit and the water-side electrode unit to the water-based fire-extinguishing agent being subjected to a jetting process by the small-particle jetting nozzle and the large-particle jetting nozzle so as to electrify the jetted particles.

The electrification spray head has:

a large-particle-size jetting nozzle converting the water-based fire-extinguishing agent into particles having a large particle size by jetting the agent to external space so as to spray the particles, a small-particle jetting nozzle coaxially disposed outside with respect to the large-particle-size jetting nozzle and converting the water-based fire-extinguishing agent into particles having a small particle size by jetting the agent to the external space so as to spray the particles, a water-current swirling core swirling a water current supplied to the large-particle-size jetting nozzle, a water-current swirling spiral swirling a water current supplied to the small-particle-size jetting nozzle, an induction electrode unit disposed in a jetting space side of the jetting nozzle, and a water-side electrode unit disposed in an inflow side of the jetting nozzles so as to be in contact with the water-based fire-extinguishing agent; and the voltage application unit applies an external electric field generated by applying a voltage between the induction electrode unit and the water-side electrode unit to the water-based fire-extinguishing agent being subjected to a jetting process by the small-particle jetting nozzle and the large-particle jetting nozzle so as to electrify the jetted particles.

The electrification spray head has:

a rotating jet nozzle rotated by jetting of the water-based fire-extinguishing agent to external space, a small-particle nozzle slit bored in the rotating jet nozzle and converting the water-based fire-extinguishing agent into particles having a small particle size by jetting the agent to the external space so as to spray the particles, a large-particle nozzle slit bored in the rotating jet nozzle and converting the water-based fire-extinguishing agent into particles having a large particle size by jetting the agent to the external space so as to spray the particles, an induction electrode unit disposed in a jetting space side of the jetting nozzle, and a water-side electrode unit disposed in an inflow side of the rotating jet nozzle so as to be in contact with the water-based fire-extinguishing agent; and the voltage application unit applies an external electric field generated by applying a voltage between the induction electrode unit and the water-side electrode unit to the water-based fire-extinguishing agent being subjected to a jetting process by the small-particle nozzle slit and the large-particle nozzle slit so as to electrify the jetted particles.

The electrification spray head positively or negatively electrifies the particles of the fire-extinguishing agent included in the predetermined particle size range.

Effect of the Invention

According to the present invention, the groups of the water-based electrified fire-extinguishing-agent particles in which the comparatively small particle size and the comparatively large particle size included in the predetermined particle size range such as the range of 30 μm to 2000 μm are mixed is discharged from the electrification spray head.

Therefore, the group of the fire-extinguishing-agent small-particle-size particles having an average particle size in the range of 30 μm to 200 μm wherein a fire extinguishing effect and a smoke removing effect are high can be sprayed over a wide range by the air convection caused by the group of the fire-extinguishing-agent particles having a large average particle size in the range of 200μ to 2000 μm wherein the flying distance thereof is long.

For example, in the case of the spray of the group of the fire-extinguishing-agent particles having a comparatively large particle size of, for example, 1000 μm to 2000 μm, the particles can be easily sprayed over a range of about 4 m even with a comparatively low pressure of about 0.1 Mp, and an air convection along the spray pattern is observed in this spray. The group of the small fire-extinguishing-agent particles are placed on and carried by the convection; as a result, the group of the small fire-extinguishing-agent particles can be sprayed over a wide range together with the group of the large fire-extinguishing-agent particles, and the groups of large and small fire-extinguishing-agent particles can be sprayed all over the protection zone by a small number of spray heads.

In the case of a fire in an initial stage (comparatively small fire), a sufficient fire extinguishing effect can be obtained by the group of the fire-extinguishing-agent particles having the small particle size. However, in the case of arson fire using heating oil, gasoline, or the like, a large-scale fire is suddenly started in some cases. The amount of heat generation in such a fire is large, a comparatively large amount of fire-extinguishing agent (water) that is not vanished by the fire has to be injected to the fire origin. The large-particle-size fire-extinguishing agent has the function to weaken the intensity of the fire with respect to such a fire. However, the large-particle-size agent is not good at extinguishing the fire continuously burning in small gaps thereafter and extinguishing fire at the part which cannot be seen from the head (blind area). On the other hand, the small fire-extinguishing-agent particles have the function of going around, wetting, and extinguishing the gaps and hidden part by the Coulomb force, and high fire extinguishing performance can be obtained by the mutual effects even in arson fire, etc.

Moreover, both of the fire-extinguishing-agent small particles and the fire-extinguishing-agent large particles are positively electrified or negatively electrified. As a result, association mutually between the fire extinguishing agent of the fire-extinguishing-agent small particles and fire-extinguishing-agent large particles can be prevented in the spray space.

BEST MODE FOR CARRYING OUT THE INVENTION

Figure 1:
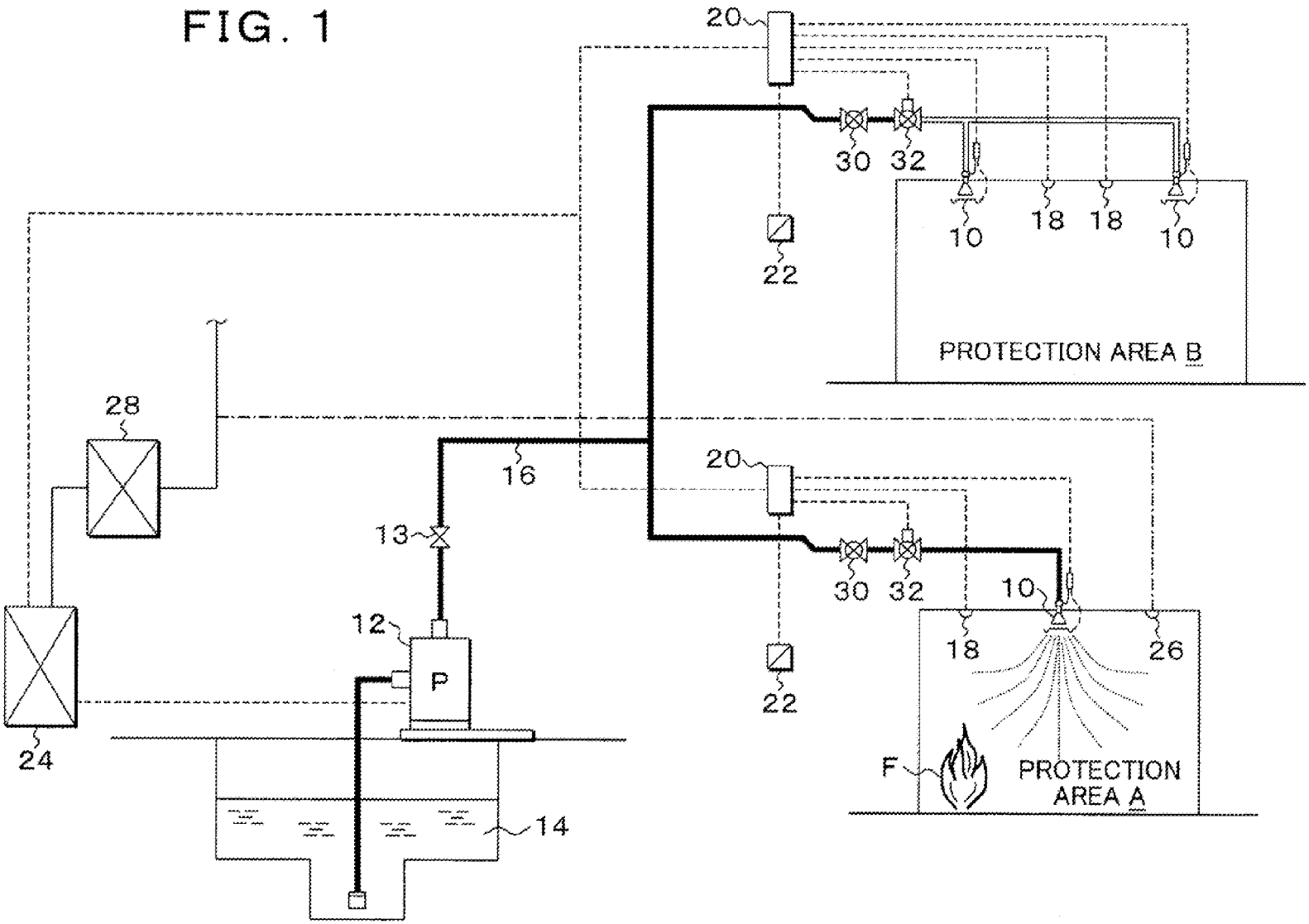
FIG. 1 is an explanatory drawing showing an embodiment of fire prevention equipment according to the present invention.

FIG. 1 is an explanatory drawing showing an embodiment of a fire prevention equipment according to the present invention. In FIG. 1, electrification spray heads 10 according to the present embodiment are installed on the ceiling side of protection areas A and B such as computer rooms in a building.

A pipe 16 is connected to the electrification spray heads 10 via a manual valve (gate valve) 13 from the projecting side of a pump unit 12 installed for a water source 14, which functions as fire extinguishing agent supplying equipment. The pipe 16 is branched and then connected to the electrification spray heads 10, which are installed in the protection areas A and B, via pressure regulating valves 30 and automatic open/close valves 32.

A dedicated fire detector 18, which controls the spraying from the electrification spray heads 10, is installed in each of the protection areas A and B. A linked control relaying devices 20 is provided for each of the protection areas A and B, and a manual operation box 22 for controlling the spray from the electrification spray heads 10 by manual operations is further provided for each of them.

Signal lines from the dedicated fire detector and the manual operation box 22 are connected to each of the linked control relaying devices 20, and a signal line for applying the voltage for electrification drive to the electrification spray head 10 and a signal line for subjecting the automatic open/close valve 32 to open/close control are wired thereto.

Furthermore, a fire detector 26 of automatic fire alarm equipment is installed in the protection area A and is connected to a detector line from a receiver 28 of the automatic fire alarm equipment. The fire detector 26 of the automatic fire alarm equipment is not provided for the protection area B; however, it goes without saying that the detector may be provided in accordance with needs.

The linked control relaying devices 20 installed to correspond to the protection areas A and B, respectively, are connected to a system monitoring control board 24 by signal lines. The receiver of the automatic fire alarm equipment is also connected to the system monitoring control board 24. Furthermore, the system monitoring control board 24 is connected to the pump unit 12 by a signal line and controls pump start/stop of the pump unit 12.

Figure 2:
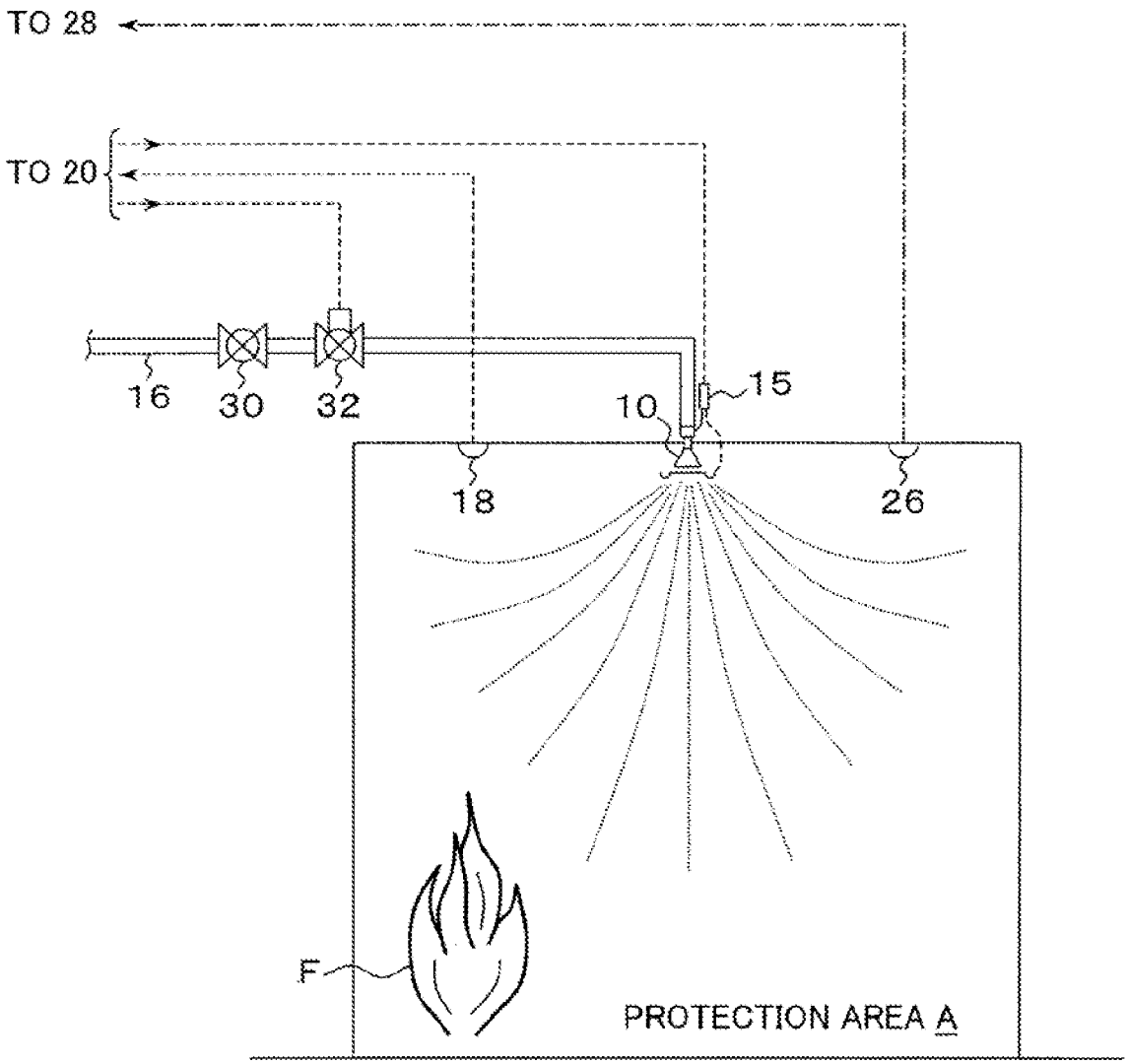
FIG. 2 is an explanatory drawing focusing on a protection area A of FIG. 1.

FIG. 2 is an explanatory drawing focusing on the protection area A of FIG. 1. The electrification spray head 10 is installed in the ceiling side of the protection area A. The pipe 16 from the pump unit 12 shown in FIG. 1 is connected to the electrification spray head 10 via the pressure regulating valve 30 and the automatic open/close valve 32.

A voltage application unit 15 is installed at an upper part of the electrification spray head 10 so as to apply a predetermined voltage to the electrification spray head 10 as is elucidated in later explanation so that the fire extinguishing agent jetted from the electrification spray head 10 can be electrified and sprayed. Moreover, the dedicated fire detector 18 is installed in the ceiling side of the protection area A, and the fire detector 26 of the automatic fire alarm equipment is also connected thereat.

Figure 3A:
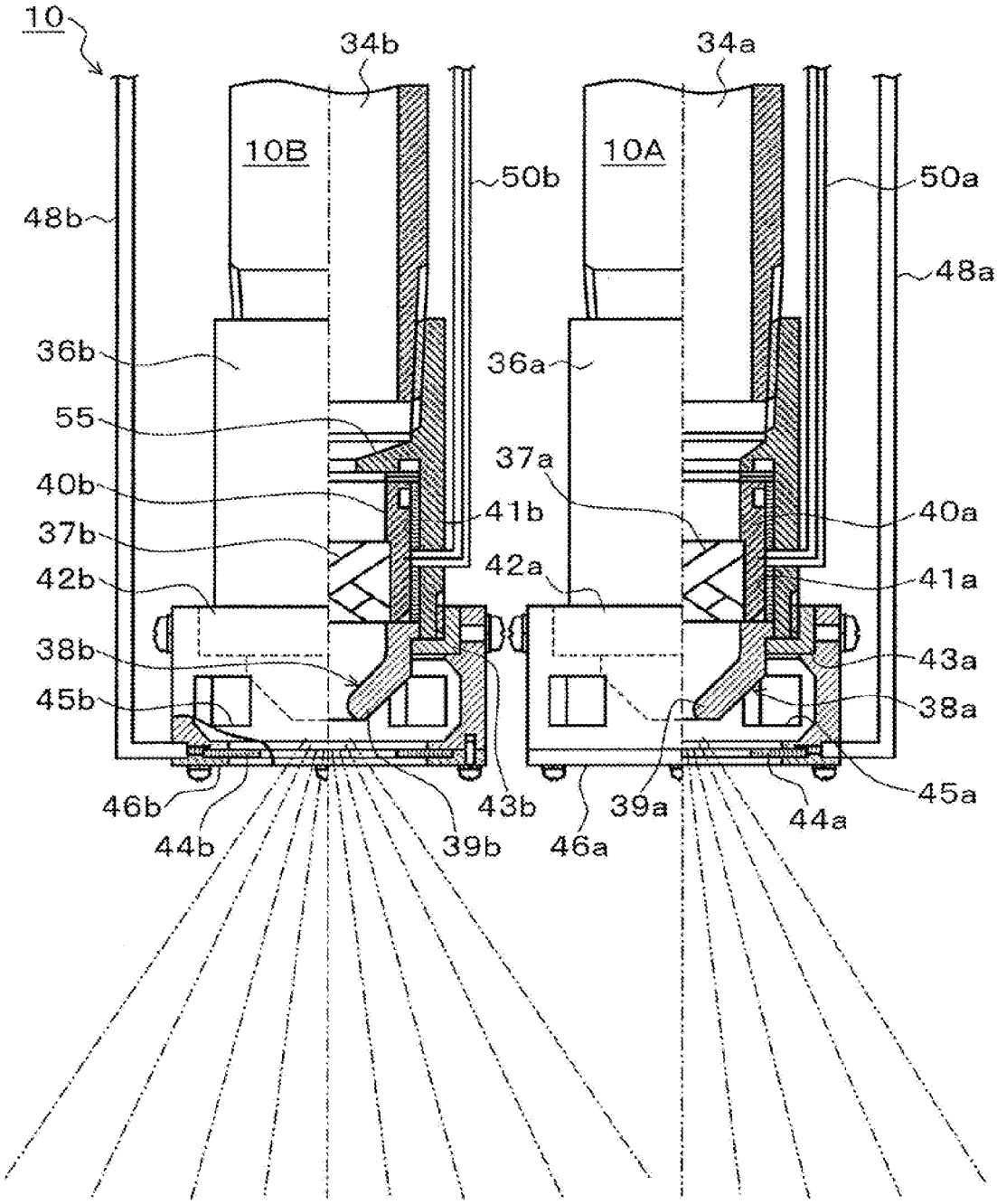
FIGS. 3A, 3B, and 3C are explanatory drawings showing the first embodiment of the electrification spray head according to the present invention.
Figure 3B:
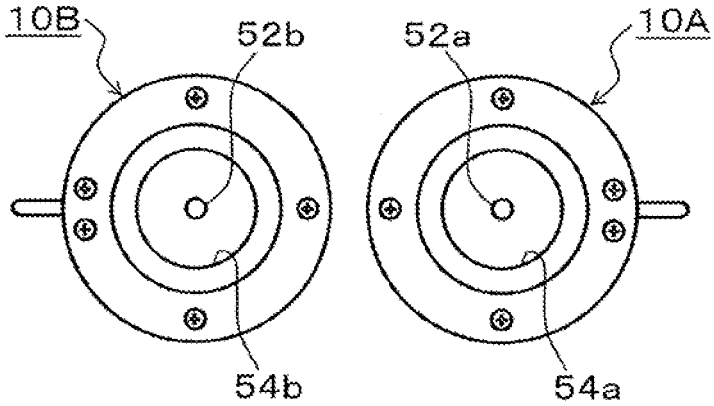
Figure 3C:
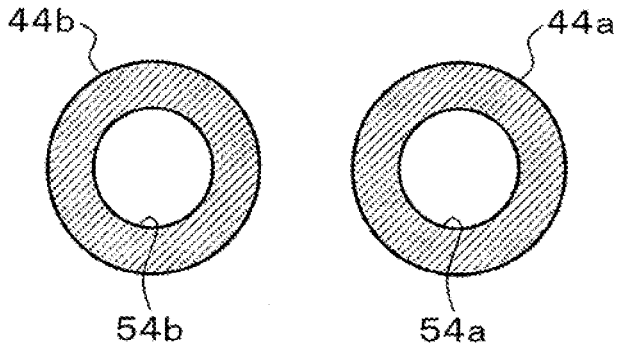

FIGS. 3A, 3B, and 3C show a first embodiment of the electrification spray head 10 shown in FIG. 1 and FIG. 2; wherein FIG. 3A shows a cross section, FIG. 3B shows a plan view viewed from the lower side, and FIG. 3C focuses on an induction electrode.

In FIG. 3A, the electrification spray head 10 is composed of a small-particle head unit 10A and a large-particle head unit 10B, and both of them are laterally arranged so as to be adjacent to each other. The electrification spray head 10 discharges a water-based fire extinguishing agent in which comparatively-small particle sizes and comparatively-large particle sizes included in a predetermined particle-size range are mixed. For example, the electrification spray head 10 discharged the water-based fire extinguishing agent in which the comparatively-small particle sizes and the comparatively-large particle sizes included in the range of 30 μm to 2000 μm are mixed.

In the head, the small-particle head unit 10A discharges a group of fire extinguishing agent particles having an average particle size within the range of 30 μm to 200 μm, and the large-particle head unit 10B discharges a group of fire extinguishing agent particles having an average particle size within the range from 200μ to 2000 μm.

The structure of the small-particle head unit 10A is as described below. In the small-particle head unit 10A, a head main body 36*a* is screw-fixed with a distal end of a falling pipe 34*a* connected to the pipe from the pump unit 12. A cylindrical water-side electrode unit 40*a* is incorporated at the inside of the distal end of the head main body 36*a* via an insulating member 41*a*.

An earth cable 50*a* is wired from the voltage application unit 15, which is installed at the upper part as shown in FIG. 2, with respect to the water-side electrode unit 40*a* and is connected to the water-side electrode unit 40*a*, which is installed at the inside of the head main body 36*a* via the insulating member 41*a*. The application voltage of the water-side electrode unit 40 is caused to be 0 volt and lead to the earth side by the connection of the earth cable 50*a*.

A small-particle jetting nozzle 38*a* is provided below the water-side electrode unit 40*a*. The small-particle jetting nozzle 38*a* is composed of a water-current swirling core 37*a*, which is provided in the interior of the water-side electrode unit 40*a* side, and a nozzle head 39*b*, which is provided in the distal end side.

The small-particle jetting nozzle 38*a* receives supply of the water-based fire-extinguishing agent, which is pressurized and supplied from the pump unit 12 of FIG. 1, from the falling pipe 34*a;* and the jetting nozzle converts the water-based fire-extinguishing agent into small particles having an average particle size within the range of 30 μm to 200 μm and sprays the particles when the water-based fire-extinguishing agent passes through the head main body 36*a* and is jetted from the nozzle head 39*a* to the outside. In the present embodiment, the spray pattern sprayed from the small-particle jetting nozzle 38*a* has the shape of a so-called full cone.

A cover 42*a* using an insulating material is fixed by screw-fixing with respect to the small-particle jetting nozzle 38*a* via a fixing member 43*a*. The cover 42*a* is an approximately-cylindrical member and incorporates a ring-like induction electrode unit 44*a* in an open part in the lower side by screw-fixing of a stopper ring 46*a*.

As is focused on in FIG. 3C, the induction electrode unit 44*a* forms an opening 54*a*, which allows the jetted particles from the small-particle jetting nozzle 38*a* to pass therethrough, at the center of a ring-like main body thereof.

With respect to the ring-like induction electrode unit 44*a* disposed below the cover 42*a,* a voltage application cable 48*a* is wired from the voltage application unit 15 in the upper part shown in FIG. 2; and the voltage application cable 48*a* penetrates through the cover 42*a*, which is composed of the insulating material, and is connected to the induction electrode unit 44*a* so that a voltage can be applied thereto. Herein, the water-side electrode unit 40*a* and the induction electrode unit 44*a* used in the electrification spray head 10 of the present embodiment may be, other than metal having electrical conductivity, a resin having electrical conductivity, rubber having electrical conductivity, or a combination of these.

When the water-based fire-extinguishing chemical agent is to be sprayed from the small-particle head unit 10A, the voltage application unit 15 shown in FIG. 2 is operated by a control signal, which is from the linked control relaying device 20 shown in FIG. 1, and applies a DC, AC, or pulsed application voltage of, for example, less than 20 kilovolts to the induction electrode unit 44*a* while the water-side electrode unit 40 serves as the earth side of 0 volt.

When a voltage of, for example, several kilovolts is applied between the water-side electrode unit 40*a* and the induction electrode unit 44*a* in this manner, an external electric field is generated between the electrodes by this voltage application, the jetted small particles are electrified through the jetting process of converting the water-based fire-extinguishing agent to the jetted small particles having the average particle size in the range of 30 μm to 200 μm from the small-particle jetting nozzle 38*a*, and the electrified jetted small particles can be sprayed to the outside.

The structure of the large-particle head unit 10B is basically the same as that of the small-particle head unit 10A, but is different in the point that a group of fire-extinguishing agent particles having an average particle size in the range of 200μ to 2000 μm is discharged.

Specifically, in the large-particle head unit 10B, a head main body 36*b* is screw-fixed with a distal end of a falling pipe 34*b* connected to the pipe from the pump unit 12.

A pressure limiting orifice 55 is provided inside the head main body 36*b*. The water pressure in a nozzle head 39*a* is largely reduced through passage through the pressure limiting orifice 55, and jetting of large-particle sizes can be obtained. A cylindrical water-side electrode unit 40*b* is incorporated at the inside of the distal end of the head main body 36*b* via an insulating member 41*b*.

An earth cable 50*b* is wired from the voltage application unit 15, which is installed at the upper part as shown in FIG. 2, with respect to the water-side electrode unit 40*b* and is connected to the water-side electrode unit 40*b*, which is installed at the inside of the head main body 36*b* via the insulating member 41*b*. The application voltage of the water-side electrode unit 40*b* is caused to be 0 volt and lead to the earth side by the connection of the earth cable 50*b*.

A large-particle jetting nozzle 38*b* is provided below the water-side electrode unit 40*b*. The jetting nozzle 38*b* is composed of a water-current swirling core 37*b*, which is provided in the interior of the water-side electrode unit 40*b* side, and a nozzle head 39*b*, which is provided in the distal end side.

The large-particle jetting nozzle 38*b* receives supply of the water-based fire-extinguishing agent, which is pressurized and supplied from the pump unit 12 of FIG. 1, from the falling pipe 34*b;* and the jetting nozzle converts the water-based fire-extinguishing agent into large particles having an average particle size within the range of 200 μm to 2000 μm and sprays the particles when the water-based fire-extinguishing agent passes through the head main body 36*b* and is jetted from the nozzle head 39*b* to the outside via the pressure limiting orifice 55. In the present embodiment, the spray pattern sprayed from the large-particle jetting nozzle 38*b* has the shape of a so-called full cone.

A cover 42*b* using an insulating material is fixed by screw-fixing with respect to the large-particle jetting nozzle 38*b* via a fixing member 43*b*. The cover 42*b* is an approximately-cylindrical member and incorporates a ring-like induction electrode unit 44*b* in an open part in the lower side by screw-fixing of a stopper ring 46*b*.

As is focused on in FIG. 3C, the induction electrode unit 44*b* forms an opening 54*b*, which allows the jetted particles from the large-particle jetting nozzle 38*b* to pass therethrough, at the center of a ring-like main body thereof.

With respect to the ring-like induction electrode unit 44*b* disposed below the cover 42*b,* a voltage application cable 48*b* is wired from the voltage application unit 15 in the upper part shown in FIG. 2; and the voltage application cable 48*b* penetrates through the cover 42*b*, which is composed of the insulating material, and is connected to the induction electrode unit 44*b* so that a voltage can be applied thereto.

Herein, the water-side electrode unit 40*a* and the induction electrode unit 44*b* used in the electrification spray head 10 of the present embodiment maybe, other than metal having electrical conductivity, a resin having electrical conductivity, rubber having electrical conductivity, or a combination of these.

When the water-based fire-extinguishing chemical agent is to be sprayed from the large-particle head unit 10B, the voltage application unit 15 shown in FIG. 2 is operated by a control signal, which is from the linked control relaying device 20 shown in FIG. 1, and applies a DC, AC, or pulsed application voltage of, for example, less than 20 kilovolts to the ring-like induction electrode unit 44*b* while the water-side electrode unit 40*b* serves as the earth side of 0 volt.

When a voltage of, for example, several kilovolts is applied between the water-side electrode unit 40*b* and the induction electrode unit 44*b* in this manner, an external electric field is generated between the electrodes by this voltage application, the jetted large particles are electrified through the jetting process of converting the water-based fire-extinguishing agent to the jetted large particles having the average particle size in the range of 200 μm to 2000 μm from the large-particle jetting nozzle 38*b*, and the electrified jetted large particles can be sprayed to the outside.

The jetting of the group of fire-extinguishing agent small particles by the small-particle head unit 10A and the jetting of the group of fire-extinguishing agent large particles by the large-particle head unit 10B is carried out at the same time to mix them. Therefore, air convection is generated by the group of the fire-extinguishing agent large particles within the range of 200 μm to 2000 μm in accordance with the spray pattern thereof, the group of the fire-extinguishing small particles within the range of 30 μm to 200 μm is carried by the air convection, the group of the fire-extinguishing agent small particles can be sprayed over a wide area together with the group of the fire-extinguishing agent large particles, and the fire-extinguishing agent which is the mixture of the small particles and the large particles can be sprayed all over the protection zone by a small number of electrification spray head 10.

For example, in the spray of the group of the fire-extinguishing agent particles by the large-particle head unit 38*b*, even if a pressure of about 1.0 Mp is supplied, the pressure is reduced to a pressure of, for example, about 0.1 Mp by the pressure limiting orifice 55, thereby changing the sizes of the fire-extinguishing agent particles to large-particle sizes of 1000 μm to 2000 μm, and the particles can be sprayed over the range of about 4 meters. By virtue of the convection generated in the spray of such a group of fire-extinguishing agent large particles, a group of small fire-extinguishing agent particles of 30 μm to 200 μm also sprayed at a pressure of 1.0 Mp from the small-particle head unit 38*a* can be reliably sprayed over a wide range of about 4 meters.

Next, a monitoring operation in the embodiment of FIG. 1 will be explained. If fire F occurs in the protection area A at this point, for example, the dedicated fire detector 18 detects the fire and transmits a fire detection signal to the system monitoring control board 24 via the linked control relaying device 20.

When the system monitoring control board 24 receives the emission of the alarm of the dedicated fire detector 18 installed in the protection area A, the system monitoring control board 24 activates the pump unit 12, pumps up the fire extinguishing water from the water source 14, pressurizes the water by the pump unit 12, and supplies the water to the pipe 16.

At the same time, the system monitoring control board 24 outputs an activation signal of the electrification spray head 10 to the linked control relaying device 20, which is provided to correspond to the protection area A. In response to this activation signal, the linked control relaying device 20 carries out an operation of opening the automatic open/close valve 32, thereby supplying the water-based fire-extinguishing agent of a constant pressure regulated by the pressure regulating valve 30 to the electrification spray head 10 via the opened automatic open/close valve and spraying the fire-extinguishing agent as jetted particles from the electrification spray head 10 to the protection area A as focused in FIG. 2.

At the same time, the linked control relaying device 20 transmits an activation signal to the voltage application unit 15 provided at the electrification spray head 10 shown in FIG. 2; and, in response to the activation signal, the voltage application unit 15 supplies a DC, AC, or pulsed application voltage of, for example, several kilovolts to the electrification spray head 10.

Therefore, in the electrification spray head 10 shown in FIG. 3A, when the pressurized water-based fire-extinguishing agent is to be converted to jetted particles and sprayed from each of the small-particle jetting nozzle 38*a* of the small-particle head nit 10A and the large-particle jetting nozzle 38*b* of the large-particle head unit 10B, a voltage of several kilovolts is applied to the induction electrode units 44*a* and 44*b* side connected to the voltage application cables 48*a* and 48*b* while the water-side electrode units 40*a* and 40*b* connected to the earth cables 50*a* and 50*b* are at 0 volt. The external electric field generated by this voltage application can be applied to the water-based fire-extinguishing agent which is in the jetting process in which the agent is jetted from the small-particle jetting nozzle 38*a* and the large-particle jetting nozzle 38*b* and passes through the openings 54*a* and 54*b* of the induction electrode units 44*a* and 44*b* so as to electrify the fire-extinguishing-agent small particles and the fire-extinguishing-agent large particles converted by the jetting, them mix the particles, and spray the particles.

As is focused on in FIG. 2, the group of the fire-extinguishing-agent large particles is sprayed from the electrification spray head 10 toward the protection area A, in which the fire F is generated, and the group of the fire-extinguishing-agent small particles of 30 to 200 μm can be reliably carried and sprayed to a wide area by the air convection generated by the spray of the group of the fire-extinguishing-agent large particles of 200 to 2000 μm, particularly, by the spray of the group of the comparatively-large fire-extinguishing-agent particles of 1000 to 2000 μm.

The group of the fire-extinguishing-agent small particles of 30 to 200 82 m is electrified. Therefore, the water particles efficiently adhere to high-temperature burning sources of the fire F because of the Coulomb force caused by the electrification, and adhesion to all the surfaces of burning materials occur at the same time; wherein, compared with the case in which conventional non-electrified water particles are sprayed, the wetting effect with respect to the burning materials is significantly increased, and a high fire extinguishing ability is exerted.

Moreover, as a result of spraying the group of the fire-extinguishing-agent large particles, the intensity of fire suddenly started from a large-scale fire such as arson fire using heating oil, gasoline, or the like is weakened, and a high fire extinguishing ability is exerted by the wetting effect caused by the group of the fire-extinguishing-agent small particles sprayed at the same time.

Furthermore, for example when a positive voltage is applied to the ring-like induction electrode units 44*a* and 44*b* in a pulsed manner while the water-side electrode units 40*a* and 40*b* are at 0 volt in the small-particle head unit 10A and the large-particle head unit 10B of FIG. 3A, the sprayed water particles are electrified only with negative electric charge in the spraying.

When the fire-extinguishing-agent small particles and the fire-extinguishing-agent large particles electrified only with the negative electric charge in this manner are sprayed, repulsive force works between the electrified water particles in the air, thereby reducing the probability that the water particles are collided and associated mutually and grown and fall, and the density of the water particles staying in the air is increased. As a result, a high fire-extinguishing ability is exerted.

Furthermore, a smoke removing effect of efficiently removing the smoke generated by the fire F can be obtained by carrying and spraying the group of the electrified fire-extinguishing-agent small particles from the electrification spray head 10 to the protection area A by the air current generated in the spraying of the group of the fire-extinguishing-agent large particles.

The smoke removing effect exerted by spraying conventional water particles is a capturing action by probabilistic collision between the water particles and smoke particles; on the other hand, the smoke removing effect of the present embodiment described above collects the smoke particles, which are similarly in an electrified state, by the water particles by Coulomb force by electrifying the sprayed water particles in the present embodiment, thereby exerting a remarkable smoke removing action.

Figure 4A:
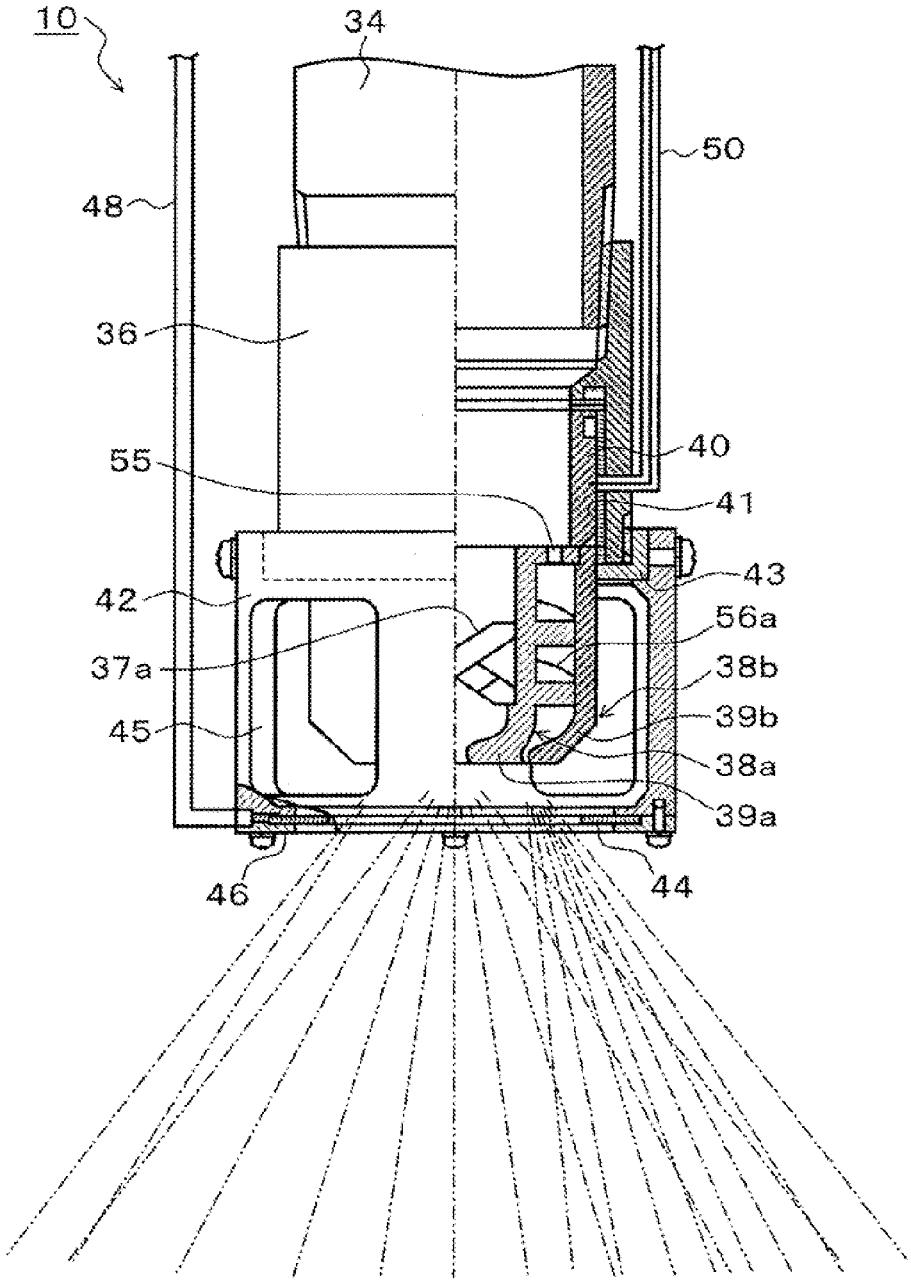
FIGS. 4A, 4B, and 4C are explanatory drawings showing a second embodiment of the electrification spray head according to the present invention.
Figure 4B:
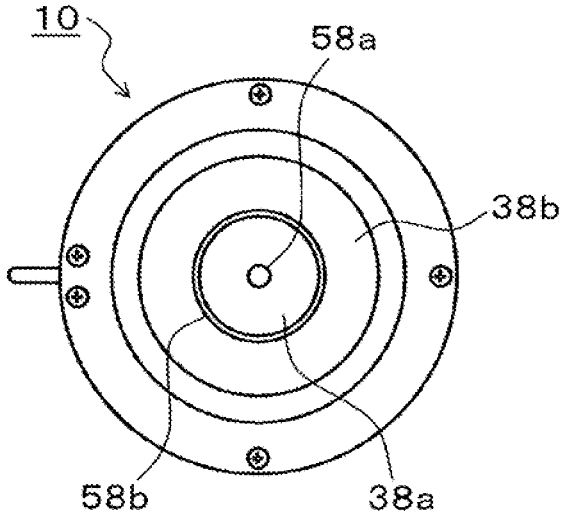
Figure 4C:
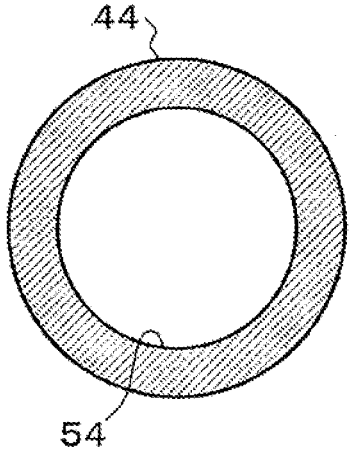

FIGS. 4A, 4B, and 4C show a second embodiment of the electrification spray head 10 shown in FIG. 1 and FIG. 2. FIG. 4A shows a cross section, FIG. 4B shows a plan view viewed from the lower side, and FIG. 4C focuses on an induction electrode.

In FIG. 4A, in the electrification spray head 10 of the second embodiment, a small-particle nozzle 38*a* constituting a small-particle head unit and a large-particle jetting nozzle 38*b* constituting a large-particle head unit are coaxially disposed.

In the electrification spray head unit 10, a head main body 36 is screw-fixed with a distal end of the falling pipe 34 connected to the pipe from the pump unit 12. A cylindrical water-side electrode unit 40 is incorporated at the inside of the distal end of the head main body 36 via an insulating member 41.

An earth cable 50 is wired from the voltage application unit 15, which is installed at the upper part as shown in FIG. 2, with respect to the water-side electrode unit 40 and is connected to the water-side electrode unit 40, which is installed at the inside of the head main body 36 via the insulating member 41. The application voltage of the water-side electrode unit 40 is caused to be 0 volt and lead to the earth side by the connection of the earth cable 50.

The small-particle jetting nozzle 38*a* is provided below the water-side electrode unit 40, and the large-particle jetting nozzle 38*b* is coaxially provided outside thereof. The small-particle jetting nozzle 38*a* is composed of a water-current swirling core 37*a* provided in the interior thereof and a nozzle head 39*a* provided in the distal-end side. The large-particle jetting nozzle 38*b* is composed of a pressure limiting orifice 55 provided on the outer periphery of the nozzle head 39*a* positioned inside, a water-current swirling spiral 56*a*, and a nozzle head 39*b* provided in the distal end side.

As shown in FIG. 4B, the small-particle jetting head 38*a* forms a small-particle nozzle hole 58*a* downward, and the large-particle jetting head 38*b* forms a ring-like large-particle nozzle opening 58*b* outside thereof.

The small-particle jetting nozzle 38*a* receives supply of the water-based fire-extinguishing agent, which is pressurized and supplied from the pump unit 12 of FIG. 1, from the falling pipe 34; and the jetting nozzle converts the water-based fire-extinguishing agent into small particles having an average particle size within the range of 30 μm to 200 μm and sprays the particles when part of the water-based fire-extinguishing agent passes through the head main body 36 and is jetted from the nozzle head 39*a* to the outside. In the present embodiment, the spray pattern sprayed from the small-particle jetting nozzle 38*a* has the shape of a so-called full cone.

The large-particle jetting nozzle 38*b* receives supply of the water-based fire-extinguishing agent, which is pressurized and supplied from the pump unit 12 of FIG. 1, from the falling pipe 34; and the jetting nozzle converts the water-based fire-extinguishing agent into large particles having an average particle size within the range of 200 μm to 2000 μm and sprays the particles when part of the water-based fire-extinguishing agent passes through the head main body 36 and is jetted from the nozzle head 39*b* to the outside via the pressure limiting orifice 55. In the present embodiment, the spray pattern sprayed from the small-particle jetting nozzle 38*a* has the shape of a so-called full cone.

The group of the fire-extinguishing-agent small particles sprayed from the small-particle nozzle hole 58*a* positioned inside is carried by the air current generated by the spraying of the group of the fire-extinguishing-agent large particles from the large-particle nozzle opening 58*b* positioned outside in this case, the group of the fire-extinguishing-agent small particles can be sprayed over a wide range together with the group of the fire-extinguishing-agent large particles, and the fire extinguishing agent in which the small particles and the large particles are mixed can be sprayed all over the protection zone by a small number of electrification spray heads 10.

A cover 42 using an insulating material is fixed by screw-fixing with respect to the small-particle jetting nozzle 38*a* via a fixing member 43. The cover 42 is an approximately-cylindrical member and incorporates a ring-like induction electrode unit 44 in an open part in the lower side by screw-fixing of a stopper ring 46.

As is focused on in FIG. 4C, the induction electrode unit 44 forms an opening 54, which allows the jetted particles from the small-particle jetting nozzle 38*a* and the large-particle jetting nozzle 38*b* to pass therethrough, at the center of a ring-like main body thereof.

With respect to the induction electrode unit 44 disposed below the cover 42, a voltage application cable 48 is wired from the voltage application unit 15 in the upper part shown in FIG. 2; and the voltage application cable 48 penetrates through the cover 42, which is composed of the insulating material, and is connected to the induction electrode unit so that a voltage can be applied thereto.

When the water-based fire-extinguishing chemical agent is to be sprayed from the small-particle jetting nozzle 38*a* and the large-particle jetting nozzle 38*b*, the voltage application unit 15 shown in FIG. 2 is operated by a control signal, which is from the linked control relaying device 20 shown in FIG. 1, and applies a DC, AC, or pulsed application voltage of, for example, less than 20 kilovolts to the ring-like induction electrode unit 44 while the water-side electrode unit 40 serves as the earth side of 0 volt.

When a voltage of, for example, several kilovolts is applied between the water-side electrode unit 40 and the ring-like induction electrode unit 44 in this manner, an external electric field is generated between the electrodes by this voltage application, the jetted small particles are electrified through the jetting process of converting the water-based fire-extinguishing agent to the jetted small particles having the average particle size in the range of 30 μm to 200 μm from the small-particle jetting nozzle 38*a*. At the same time, the jetted large particles are electrified through the jetting process of converting the water-based fire-extinguishing agent to the jetted large particles having the average particle size in the range of 200 μm to 2000 μm from the large-particle jetting nozzle 38*b*, and the group of the electrified fire-extinguishing-agent small particles and the group of the fire-extinguishing-agent large particles can be mixed with each other and sprayed to the outside.

According to the electrification spray head 10 in which the small-particle jetting nozzle 38*a* and the large-particle jetting nozzle 38*b* are coaxially disposed, the head can be downsized, and installation space and cost can be reduced compared with the first embodiment of FIGS. 3A to 3C in which the nozzles are adjacently disposed.

Figure 5A:
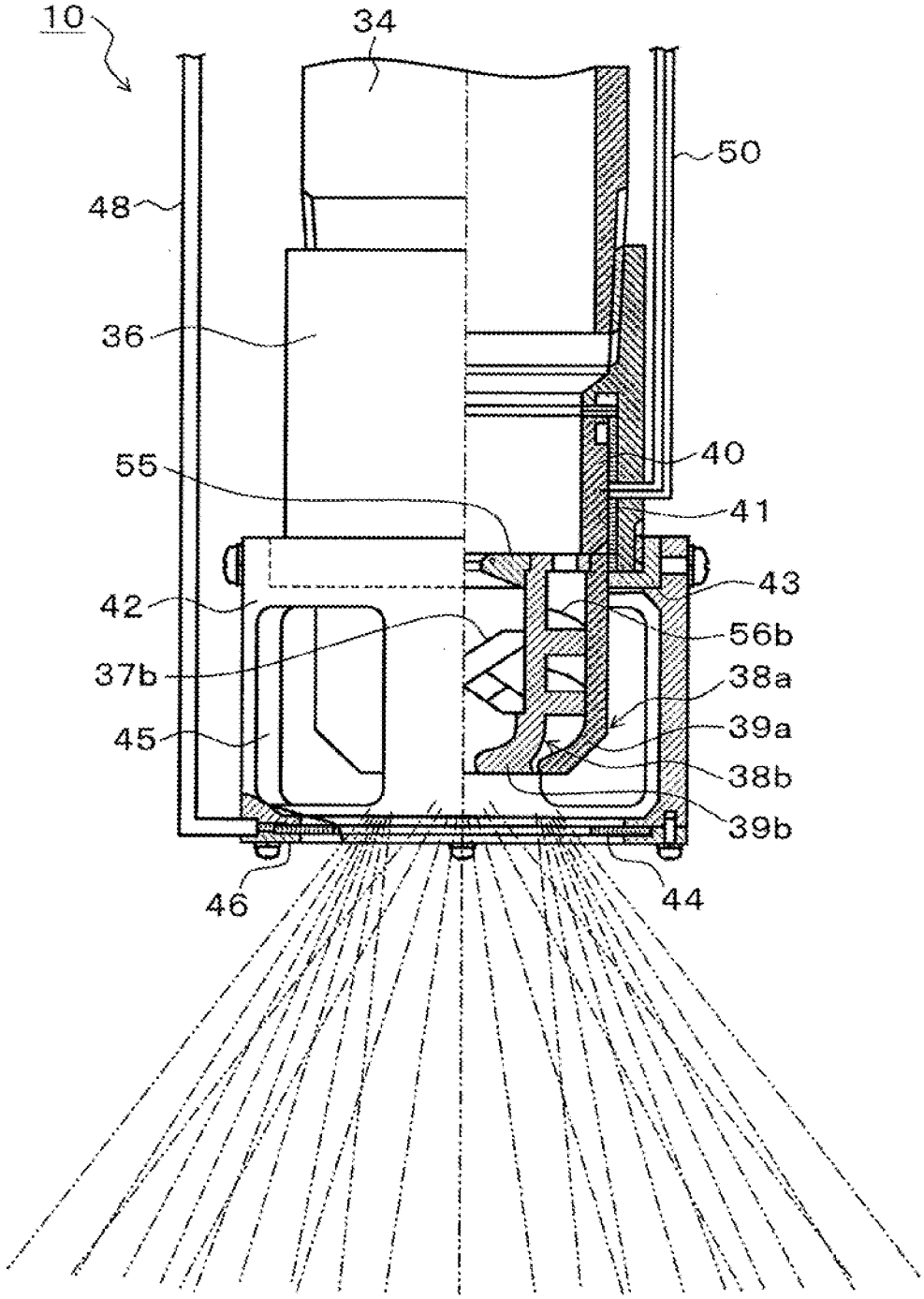
FIGS. 5A, 5B, and 5C are explanatory drawings showing a third embodiment of the electrification spray head according to the present invention.
Figure 5B:
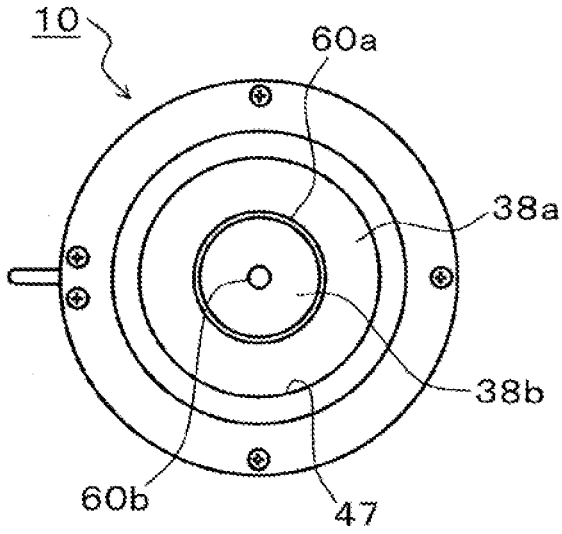
Figure 5C:
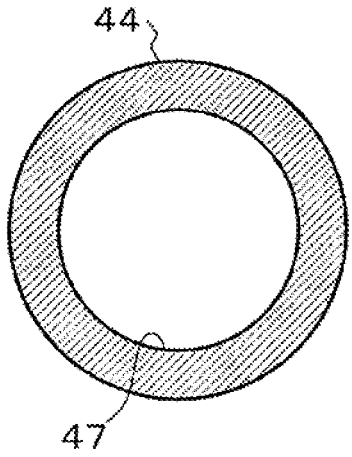

FIGS. 5A, 5B, and 5C show a third embodiment of the electrification spray head 10 shown in FIG. 1 and FIG. 2. FIG. 5A shows a cross section, FIG. 5B is a plan view viewed from the lower side, and FIG. 5C focuses on an induction electrode.

In FIG. 5A, contrary to the second embodiment of FIGS. 4A to 4C, the electrification spray head of the third embodiment is characterized by disposing a large-particle jetting nozzle 38*b* at the center and coaxially disposing a small-particle jetting nozzle 38*a* outside thereof. The large-particle jetting nozzle 38*b* disposed at the center is composed of a pressure limiting orifice 55 provided inside, a water-current swirling core 37*b*, and a nozzle head 39*b* provided in the distal end side. The small-particle jetting nozzle 38*a* provided outside is composed of a water-current swirling spiral 56*b* provided at the outer periphery of the nozzle head 39*b* disposed inside, and a nozzle head 39*a* provided in the distal end side.

As shown in FIG. 5B, the inside large-particle jetting head 38*b* forms a large-particle nozzle hole 60*b* downward, and the outside small-particle jetting head 38*a* forms a ring-like small-particle nozzle opening 60*a* outside thereof.

The structures other than that are same as those of the second embodiment of FIGS. 4A to 4C; therefore, the structures are denoted by the same numbers, and the explanation thereof will be omitted.

Also in the second embodiment of FIGS. 5A to 5C, the small-particle jetting nozzle 38*a* receives supply of the water-based fire-extinguishing agent, which is pressurized and supplied from the pump unit 12 of FIG. 1, from the falling pipe 34; and the jetting nozzle converts the water-based fire-extinguishing agent into small particles having an average particle size within the range of 30 μm to 200 μm and sprays the particles when part of the water-based fire-extinguishing agent passes through the head main body 36 and is jetted from the nozzle head 39*a* to the outside.

At the same time, the large-particle jetting nozzle 38*b* receives supply of the water-based fire-extinguishing agent, which is pressurized and supplied from the pump unit 12 of FIG. 1, from the falling pipe 34; and the jetting nozzle converts the water-based fire-extinguishing agent into large particles having an average particle size within the range of 200 μm to 2000 μm and sprays the particles when part of the water-based fire-extinguishing agent passes through the head main body 36 and is jetted from the nozzle head 39*b* to the outside via the pressure limiting orifice 55.

The group of the fire-extinguishing-agent small particles sprayed from the small-particle nozzle opening 60*a* positioned outside is carried by the air current generated by the spraying of the group of the fire-extinguishing-agent large particles from the large-particle nozzle opening 60*b* positioned inside in this case, the group of the fire-extinguishing-agent small particles can be sprayed over a wide range together with the group of the fire-extinguishing-agent large particles, and the fire extinguishing agent in which the small particles and the large particles are mixed can be sprayed all over the protection zone by a small number of electrification spray heads 10.

When a voltage of, for example, several kilovolts is applied between the water-side electrode unit 40 and the induction electrode unit 44, an external electric field is generated between the electrodes by this voltage application, the jetted small particles are electrified through the jetting process of converting the water-based fire-extinguishing agent to the jetted small particles having the average particle size in the range of 30 μm to 200 μm from the small-particle jetting nozzle 38*a*. At the same time, the jetted large particles are electrified through the jetting process of converting the water-based fire-extinguishing agent to the jetted large particles having the average particle size in the range of 200 μm to 2000 μm from the large-particle jetting nozzle 38*b*, and the group of the electrified fire-extinguishing-agent small particles and the group of the fire-extinguishing-agent large particles can be mixed with each other and sprayed to the outside.

According to the electrification spray head of the third embodiment in which the small-particle jetting nozzle 38*a* and the large-particle jetting nozzle 38*b* are coaxially disposed, the head can be downsized, and installation space and cost can be reduced compared with the first embodiment of FIGS. 3A to 3C in which the nozzles are adjacently disposed.

Contrary to the second embodiment, the large-particle jetting nozzle 38*b* is disposed inside; therefore, the group of the fire-extinguishing-agent small particles sprayed from the small-particle jetting nozzle 38*a* disposed outside is carried so as to be expanded by the air current generated by the spraying of the group of the fire-extinguishing-agent large particles, and the group of the fire-extinguishing-agent small particles can be efficiently carried.

Figure 6A:
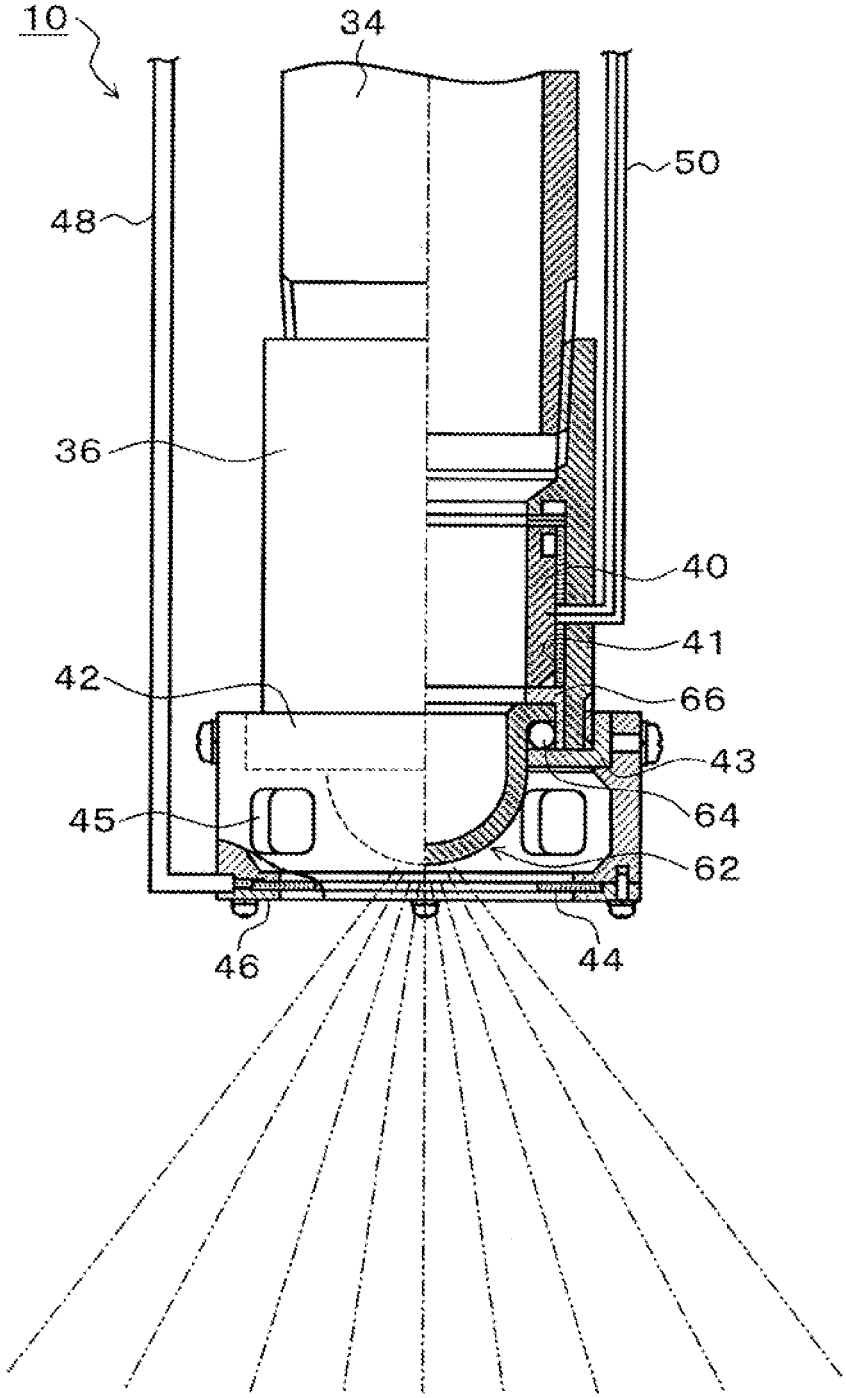
FIGS. 6A, 6B, and 6C are explanatory drawings showing a fourth embodiment of the electrification spray head according to the present invention.
Figure 6B:
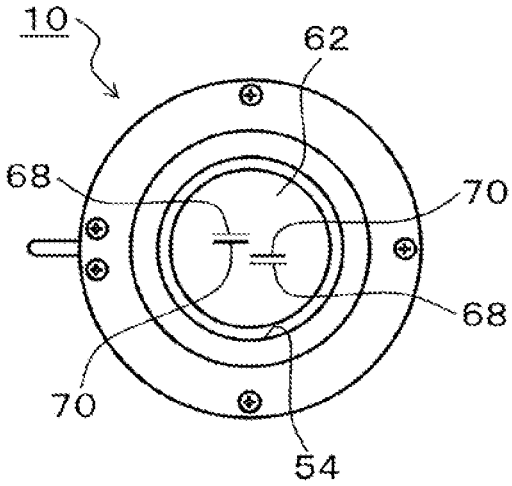
Figure 6C:
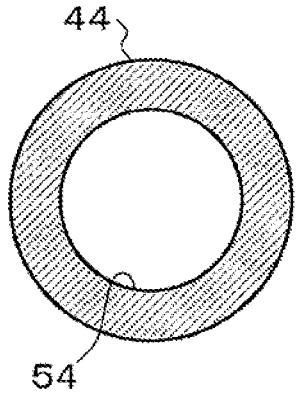

FIGS. 6A, 6B, and 6C show a fourth embodiment of the electrification spray head 10 shown in FIG. 1 and FIG. 2. FIG. 6A shows a cross section, FIG. 6B shows a plan view viewed from the lower side, and FIG. 6C focuses on an induction electrode.

In FIG. 6A, the electrification spray head 10 of the fourth embodiment is characterized in that a head nozzle constituting a small-particle head unit and a large-particle head unit 10B is a rotating jet nozzle 62. More specifically, in the electrification spray head unit 10, a head main body 36 is screw-fixed with a distal end of the falling pipe 34 connected to the pipe from the pump unit 12. A cylindrical water-side electrode unit 40 is incorporated at the inside of the distal end of the head main body 36 via an insulating member 41.

An earth cable 50 is wired from the voltage application unit 15, which is installed at the upper part as shown in FIG. 2, with respect to the water-side electrode unit 40 and is connected to the water-side electrode unit 40, which is installed at the inside of the head main body 36 via the insulating member 41. The application voltage of the water-side electrode unit 40 is caused to be 0 volt and lead to the earth side by the connection of the earth cable 50.

The rotating jet nozzle 62 is provided below the water-side electrode unit 40. The rotating jet nozzle 62 is rotatably placed inside a fixing member 43 via a bearing 64, and another fixing member 66 is disposed between there and the water-side electrode 40.

As shown in FIG. 6B, in the rotating jet nozzle 62, two pairs of small-particle jetting slits 68 and large-particle jetting slits 70 are formed at the positions offset from the rotation center.

The small-particle jetting slit 68 receives supply of the water-based fire-extinguishing agent, which is pressurized and supplied from the pump unit 12 of FIG. 1, from the falling pipe 34; and the jetting nozzle converts the water-based fire-extinguishing agent into small particles having an average particle size within the range of 30 μm to 200 μm and sprays the particles when the water-based fire-extinguishing agent passes through the head main body 36 to the outside.

The large-particle jetting slit 70 receives supply of the water-based fire-extinguishing agent, which is pressurized and supplied from the pump unit 12 of FIG. 1, from the falling pipe 34; and the jetting nozzle converts the water-based fire-extinguishing agent into large particles having an average particle size within the range of 200 μm to 2000 μm and sprays the particles when the water-based fire-extinguishing agent passes through the head main body 36 to the outside.

The small-particle jetting slits 68 and the large-particle jetting slits 70 are formed obliquely to the thickness direction. Therefore, while the rotating jet nozzle 62 is rotated by the jetting of the fire extinguishing agent from the small-particle jetting slits 68 and the large-particle jetting slits 70, the group of the fire-extinguishing-agent small particles and the group of the fire-extinguishing-agent large particles are spirally sprayed.

The group of the fire-extinguishing-agent small particles sprayed from the small-particle jetting slits 68 is carried by the air current generated by the spraying of the group of the fire-extinguishing-agent large particles from the large-particle jetting slits 70 in this case, the group of the fire-extinguishing-agent small particles can be sprayed over a wide range together with the group of the fire-extinguishing-agent large particles, and the fire extinguishing agent in which the small particles and the large particles are mixed can be sprayed all over the protection zone by a small number of electrification spray heads 10.

A cover 42 using an insulating material is fixed by screw-fixing with respect to a head main body via a fixing member 43. The cover 42 is an approximately-cylindrical member and incorporates a ring-like induction electrode unit 44 in an open part in the lower side by screw-fixing of a stopper ring 46.

As is focused on in FIG. 6C, the induction electrode unit 44 forms an opening 54, which allows the jetted particles from the small-particle jetting slits 68 and the large-particle jetting slits 70 to pass therethrough, at the center of a ring-like main body thereof.

With respect to the induction electrode unit 44 disposed below the cover 42, a voltage application cable 48 is wired from the voltage application unit 15 in the upper part shown in FIG. 2; and the voltage application cable 48 penetrates through the cover 42, which is composed of the insulating material, and is connected to the induction electrode unit so that a voltage can be applied thereto.

When the water-based fire-extinguishing chemical agent is to be sprayed from the small-particle jetting slits 68 and the large-particle jetting slits 70 of the rotating jet nozzle 62, the voltage application unit 15 shown in FIG. 2 is operated by a control signal, which is from the linked control relaying device 20 shown in FIG. 1, and applies a DC, AC, or pulsed application voltage of, for example, less than 20 kilovolts to the ring-like induction electrode unit 44 while the water-side electrode unit 40 serves as the earth side of 0 volt.

When a voltage of, for example, several kilovolts is applied between the water-side electrode unit 40 and the induction electrode unit in this manner, an external electric field is generated between the electrodes by this voltage application, the jetted small particles are electrified through the jetting process of converting the water-based fire-extinguishing agent to the jetted small particles having the average particle size in the range of 30 μm to 200 μm from the small-particle jetting slits 68 of the rotating jet nozzle 62. At the same time, the jetted large particles are electrified through the jetting process of converting the water-based fire-extinguishing agent to the jetted large particles having the average particle size in the range of 200 μm to 2000 μm from the large-particle jetting slits 70, and the group of the electrified fire-extinguishing-agent small particles and the group of the fire-extinguishing-agent large particles can be mixed with each other by rotation of the rotating jet nozzle 62 and spirally sprayed.

According to the electrification spray head 10 using the rotating jet nozzle 62, there is no need to provide the water-current swirling core or the water-current swirling spiral in the nozzle unit.

Therefore, correspondingly, the nozzle structure becomes simple, the head can be downsized, and installation space and cost can be reduced. The various structures shown in above described embodiments can be applied to the electrification spray head 10 used in the present embodiment; however, the structure is not limited thereto, and an electrification spray head having an arbitrary structure can be used.

Regarding the electrification voltage applied to the electrification spray head, whether the induction electrode unit side is to be at positive/negative application voltages, only positive application voltages, or only negative application voltages while the water-side electrode unit is at 0 volt can be also arbitrarily determined in accordance with needs depending on the situation of the burning member side serving as a fire extinguishing target.

Moreover, the present invention includes arbitrary modifications that do not impair the objects and advantages of the present invention, and the present invention is not limited by the numerical values shown in the above described embodiments.

The invention claimed is:

1. An electrification spray head comprising:

a small-particle head unit and a large-particle head unit which are laterally arranged adjacent to each other;

wherein the small-particle-size head unit has (i) a small-particle jetting nozzle converting a water-based fire-extinguishing agent into particles having an average particle size within the range of 30 μm to 200 μm by jetting the agent to external space so as to spray the particles, (ii) a water-current swirling core swirling a water current supplied to the small-particle jetting nozzle, (iii) an induction electrode unit disposed in a jetting space side of the small-particle jetting nozzle, and (iv) a water-side electrode unit disposed in the small-particle jetting nozzle and in contact with the water-based fire-extinguishing agent;

wherein the large-particle-size head unit has (i) a large-particle jetting nozzle converting the water-based fire-extinguishing agent into particles having an average particle size within the range of 200 μm to 2000 μm by jetting the agent to external space so as to spray the particles, (ii) a water-current swirling core swirling a water current supplied to the large-particle jetting nozzle, (iii) an induction electrode unit disposed in a jetting space side of the large-particle jetting nozzle, and (iv) a water-side electrode unit disposed in the large-particle jetting nozzle and in contact with the water-based fire-extinguishing agent; and wherein an external electric field is generated by applying a voltage between the induction electrode units and the water-side electrode units of the small-particle-size head unit and the large-particle-size head unit to the water-based fire-extinguishing agent being subjected to a jetting process by the small-particle jetting nozzle and the large-particle jetting nozzle so as to electrify the jetted particles.

2. An electrification spray head comprising:

(i) a small-particle jetting nozzle converting a water-based fire-extinguishing agent into particles having the small particle having an average particle size within the range of 30 μm to 200 μm by jetting the agent to external space so as to spray the particles, (ii) a large-particle jetting nozzle coaxially disposed outside with respect to the small-particle jetting nozzle and converting the water-based fire-extinguishing agent into particles having a large particle having an average particle size within the range of 200 μm to 2000 μm by jetting the agent to the external space so as to spray the particles, (iii) a water-current swirling core swirling a water current supplied to the small-particle jetting nozzle, (iv) a water-current swirling spiral swirling a water current supplied to the large-particle jetting nozzle, (v) an induction electrode unit disposed in a jetting space side of one of the jetting nozzles, and (vi) a water-side electrode unit disposed in an inflow side of the jetting nozzles and in contact with the water-based fire-extinguishing agent; and wherein an external electric field is generated by applying a voltage between the induction electrode unit and the water-side electrode unit to the water-based fire-extinguishing agent being subjected to a jetting process by the small-particle jetting nozzle and the large- particle jetting nozzle so as to electrify the jetted particles.

3. An electrification spray head comprising:

(i) a large-particle-size jetting nozzle converting a water-based fire-extinguishing agent into particles having a large particle having an average particle size within the range of 200 μm to 2000 μm by jetting the agent to external space so as to spray the particles, (ii) a small-particle jetting nozzle coaxially disposed outside with respect to the large-particle-size jetting nozzle and converting the water-based fire-extinguishing agent into particles having a small particle having an average particle size within the range of 30 μm to 200 μm by jetting the agent to the external space so as to spray the particles, (iii) a water-current swirling core swirling a water current supplied to the large-particle jetting nozzle, (iv) a water-current swirling spiral swirling a water current supplied to the small-particle jetting nozzle, (v) an induction electrode unit disposed in a jetting space side of one of the jetting nozzles, and (vi) a water-side electrode unit disposed in an inflow side of the jetting nozzles and in contact with the water-based fire-extinguishing agent; and wherein an external electric field is generated by applying a voltage between the induction electrode unit and the water-side electrode unit to the water-based fire-extinguishing agent being subjected to a jetting process by the small-particle jetting nozzle and the large-particle jetting nozzle so as to electrify the jetted particles.

4. An electrification spray head comprising:

(i) a rotating jet nozzle rotated by jetting of a water-based fire-extinguishing agent to external space, (ii) a small-particle nozzle slit bored in the rotating jet nozzle and converting the water-based fire-extinguishing agent into particles having a small particle having an average particle size within the range of 30 μm to 200 μm by jetting the agent to the external space so as to spray the particles, (iii) a large-particle nozzle slit bored in the rotating jet nozzle and converting the water-based fire-extinguishing agent into particles having a large particle having an average particle size within the range of 200 μm to 2000 μm by jetting the agent to the external space so as to spray the particles, (iv) an induction electrode unit disposed in a jetting space side of the jet nozzle, and (v) a water-side electrode unit disposed in an inflow side of the rotating jet nozzle so and in contact with the water-based fire-extinguishing agent; and wherein an external electric field is generated by applying a voltage between the induction electrode unit and the water-side electrode unit to the water-based fire-extinguishing agent being subjected to a jetting process by the small-particle nozzle slit and the large-particle nozzle slit so as to electrify the jetted particles.

* * * * *